US011185831B1

(12) United States Patent
Gruss

(10) Patent No.: US 11,185,831 B1
(45) Date of Patent: Nov. 30, 2021

(54) LIDS FOR DRINKING CUPS

(71) Applicant: Marc Allen Gruss, Cape Town (ZA)

(72) Inventor: Marc Allen Gruss, Cape Town (ZA)

( * ) Notice: Subject to any disclaimer, the term of this patent is extended or adjusted under 35 U.S.C. 154(b) by 0 days.

(21) Appl. No.: 17/314,467

(22) Filed: May 7, 2021

(30) Foreign Application Priority Data

May 7, 2020 (ZA) ..... 2020/02502

(51) Int. Cl.

| | |
|---|---|
| ***B01F 13/00*** | (2006.01) |
| ***A47G 19/22*** | (2006.01) |
| ***B65D 51/28*** | (2006.01) |
| ***B01F 15/00*** | (2006.01) |
| ***B01F 1/00*** | (2006.01) |

(52) U.S. Cl.
CPC ..... *B01F 13/0022* (2013.01); *A47G 19/2272* (2013.01); *B01F 1/0027* (2013.01); *B01F 15/00681* (2013.01); *B01F 15/00779* (2013.01); *B65D 51/2857* (2013.01); *B01F 2215/0022* (2013.01)

(58) Field of Classification Search
CPC ..... B01F 13/0022; B01F 15/00681; A47J 31/407; A47J 31/02; B65D 51/2857; A47G 19/2272
USPC ..... 366/130
See application file for complete search history.

(56) References Cited

U.S. PATENT DOCUMENTS 2,383,144 A * 8/1945 Moore ..... A47J 31/446 99/285

* cited by examiner

*Primary Examiner* — Elizabeth Insler
(74) *Attorney, Agent, or Firm* — Seed Intellectual Property Law Group LLP

(57) ABSTRACT

An open-topped drinking cup and a lid comprising a lid cover and a mixing device for holding and mixing a condiment into a beverage held in the dinking cup. The lid cover defines a circular mounting aperture within which the mixing device is displaceably located. The mixing device includes at least two mixing elements which are connected to another so as to be telescopically displaceable relative to one another between a retracted condition and an extended condition wherein the mixing device extends into the beverage. The mixing device includes a condiment chamber which is defined within a mixing element for holding a condiment such as sugar. The mixing device further includes a mixing element which has a number of circumferentially-spaced slots through which the condiment is discharged into the beverage.

9 Claims, 16 Drawing Sheets

LIDS FOR DRINKING CUPS

BACKGROUND

Technical Field

This disclosure relates to lids for drinking cups. The disclosure relates particularly to lids for drinking cups including a mixing device for mixing beverages contained in the drinking cups.

Description of the Related Art

Beverages such as coffee are commonly sold in disposable drinking cups with disposable lids. Typically, drinking cups, lids and an assortment of individually packaged condiments in the form of a variety of sugars, sugar substitutes and sweeteners and separate mixing devices for mixing the condiments into the coffee, are held in stock by coffee vendors for use by customers.

Lids, packages containing condiments, and mixing devices are typically displayed on a counter for easy access by customers. A barista, after preparing a coffee in an open-topped drinking cup for a customer, will typically hand the customer the drinking cup holding the coffee and the customer will then select one or more of the condiments and add them to the coffee. Thereafter, a mixing device is used by the customer to mix the condiment into the coffee. Finally, a lid is fitted to the drinking cup if the drinking cup is to be transported for consumption at another location.

The handling of lids and individually packaged condiments at manufacture and along the supply chain to the coffee vendor and by baristas and customers when preparing a coffee for the customer, poses an unacceptable health risk particularly in view of the potential for transmission of communicable diseases such as the highly contagious Covid-19 virus.

In addition, the provision of separate lids and mixing devices and individually packaged condiments leads to high levels of theft, wastage, and mess. Furthermore, opening individual packages of condiments, pouring the contents into a beverage, and then mixing the beverage are both inconvenient and time-consuming, particularly in the case of take-away coffee beverages where a fast service, convenience-orientated "on-the-move" coffee culture, has developed.

The provision of separate lids, mixing devices, and individually packaged condiments presents a logistics challenge to vendors as they need to maintain adequate stock levels of each item in order to satisfy their customers.

The disposal of the individual packaging for condiments and of separate mixing devices increases the amount of unwanted waste products into already stressed waste management systems of local municipalities. In many instances, mixing devices are provided in the form of single-use plastic items such as spoons and stirring rods which are generally not recyclable and. as a result, pose a substantial risk to the environment. It is for this reason that in many countries, the use of single-use plastic items, has been banned.

It is an objective of the present disclosure to ameliorate the above-mentioned problems associated with the production, supply and use of separate lids, mixing devices and individually packaged condiments in the vending of beverages such as coffee to customers.

BRIEF SUMMARY

According to the disclosure there is provided a lid for an open-topped drinking cup comprising:

a lid cover which is attachable to the drinking cup at an upper end thereof; and a mixing device for agitating a beverage in the drinking cup, characterized in that the lid cover defines a mounting aperture within which the mixing device is located in an arrangement permitting displacement of the mixing device within the mounting aperture, the mixing device including:

a. at least two mixing elements which are displaceably connected to one another so as to be extendable in order to increase an effective length of the mixing member; and b. a condiment holder for holding a condiment, which is integrated with one of the mixing elements, the condiment holder having at least one discharge opening through which the condiment is discharged from the condiment holder.

The lid cover may include an annular attachment formation for releasable attachment to a corresponding formation of the drinking cup.

The mixing device may be configured so as to be permanently retained within the mounting aperture of the lid cover of the drinking cup.

The lid cover may define at least one abutment formation adjacent the mounting aperture, for abutment with the mixing device.

The mixing device may include a lower stop formation near an operative lower end of the mixing device and an upper stop formation near an operative upper end of the mixing device, the lower and upper stop formations being operable to abut the abutment formation of the lid cover when the mixing device is raised and lowered, respectively, within the mounting aperture thereby capturing and permanently retaining the mixing device within the mounting aperture.

One of the mixing elements constitutes an upper mixing element and the other mixing element constitutes a lower mixing element, the upper mixing element including the upper stop formation and the lower mixing element including the lower stop formation.

The conduit holder may be integrated with the lower mixing element.

The mixing elements may be telescopically displaceable relative to one another between retracted and extended conditions of the mixing device. More specifically, the mixing elements may have concentric tubular configurations wherein one of the mixing elements is seated within the other mixing element in the retracted condition of the mixing device.

The mixing device may be displaceably mounted within the mounting aperture of the lid cover so as to permit an up and down bobbing action within a beverage contained within the drinking cup. As such, the mixing device may include a handle formation which can be held and manipulated for exerting a pulling force on the inner mixing element for alternately raising and lowering the mixing device within the mounting aperture for imparting the up and down bobbing action to the beverage in order to release the condiment into the beverage and promote mixing of the condiment in the beverage. The mixing device may further be displaced within the mounting aperture to impart a stirring action to promote mixing of the condiment in the beverage.

The mixing device may include one or more intermediate mixing elements telescopically interconnected between the upper and lower mixing elements.

The disclosure extends to a drinking cup and a lid as defined and described hereinabove in accordance with the disclosure, for fitment to an upper end of the drinking cup.

BRIEF DESCRIPTION OF THE SEVERAL VIEWS OF THE DRAWINGS

Further features of the disclosure and the benefits thereof are described hereinafter by way of a non-limiting example of the disclosure, with reference to and as illustrated in the accompanying diagrammatic drawings.

In the drawings.

DETAILED DESCRIPTION

Figure 1:
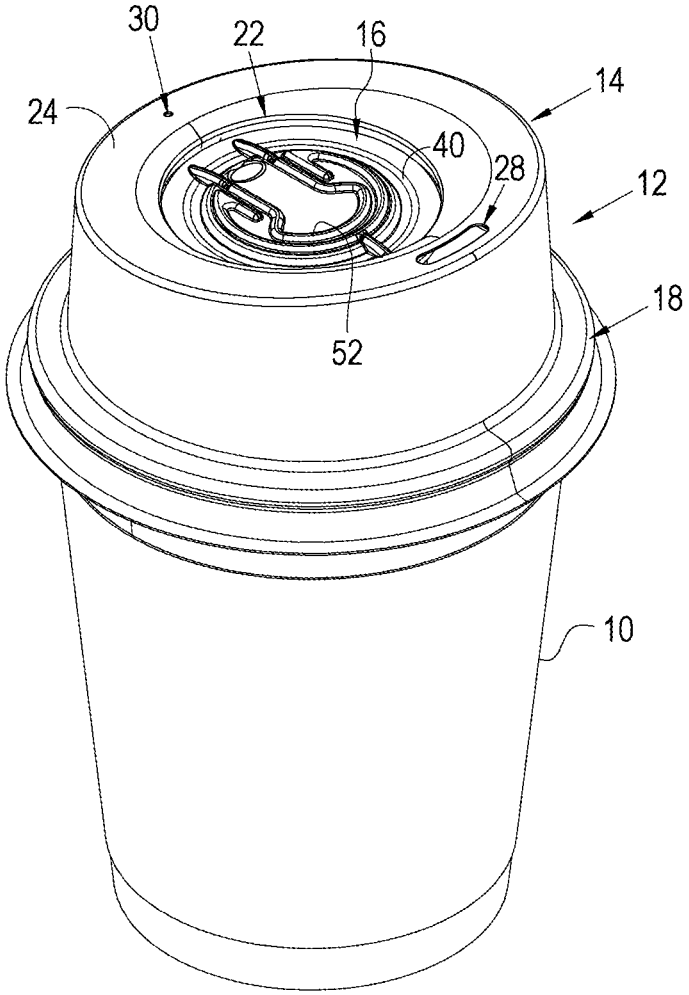
FIG. 1 shows a three-dimensional view of a drinking cup having a lid in accordance with the disclosure, fitted thereto, with a mixing device of the lid in a retracted condition.
Figure 2:
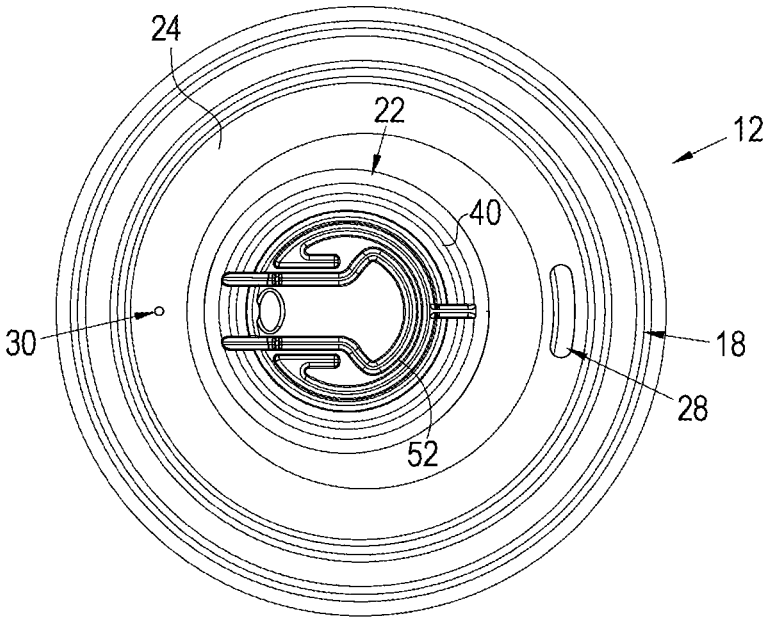
FIG. 2 shows a top plan view of the drinking cup and lid of FIG. 1.
Figure 3:
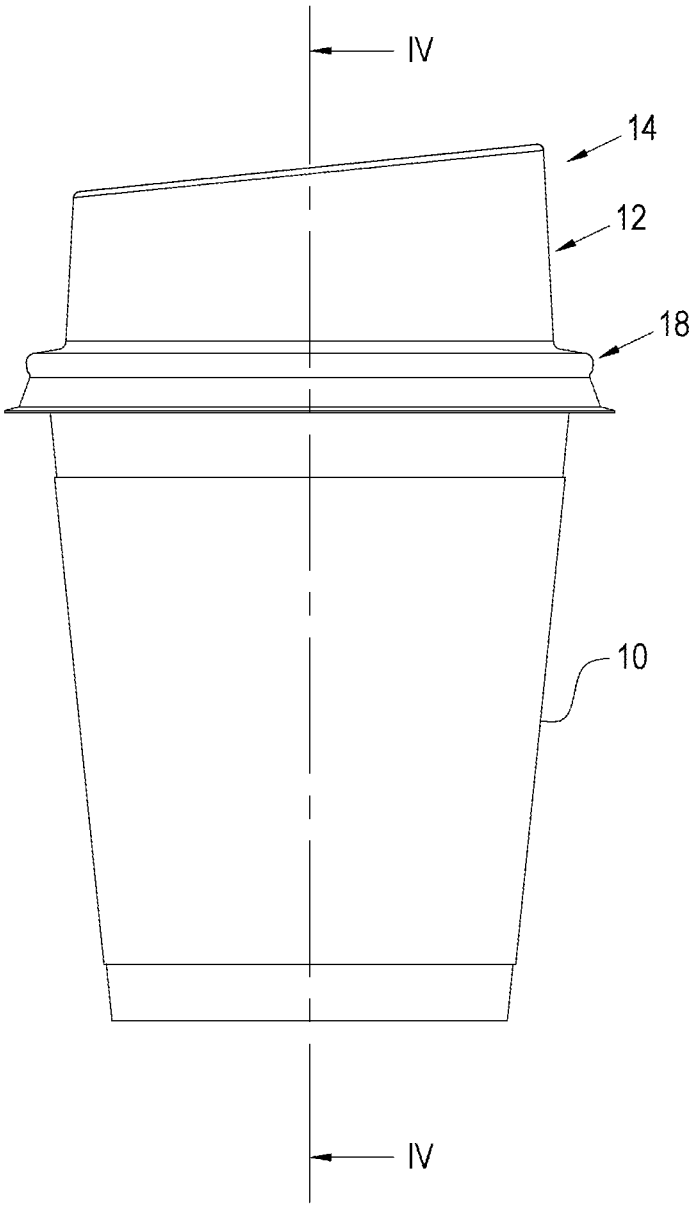
FIG. 3 shows a side view of the drinking cup and lid of FIG. 1.

In the drawings, a drinking cup 10 and a lid 12 in accordance with the disclosure, are illustrated. The drinking cup and the lid 12 are adapted for use in holding a beverage such as coffee. Any reference in this specification to a "beverage" shall be interpreted sufficiently broadly to include a reference to any potable liquid.

The drinking cup 10 is open-topped and defines a circular rim at its upper end onto which the lid 12 is fitted.

The lid comprises, broadly, a lid cover 14 and a mixing device 16.

The lid cover 14 includes a lip portion 18 defining an annular groove 19 which snap fits onto a complementary annular tongue 20 of the rim of the drinking cup. The lid cover defines a circular mounting aperture 22 within which the mixing device is displaceably located.

The mounting aperture 22 is centrally positioned and recessed below an upper surface 24 of the lid cover.

The lid cover includes an annular abutment formation 26 having a circular inner edge which defines the mounting aperture 22.

The lid cover further defines a drinking hole 28 and a breather hole 30 allowing the ingress of air as a beverage is consumed.

Figure 4:
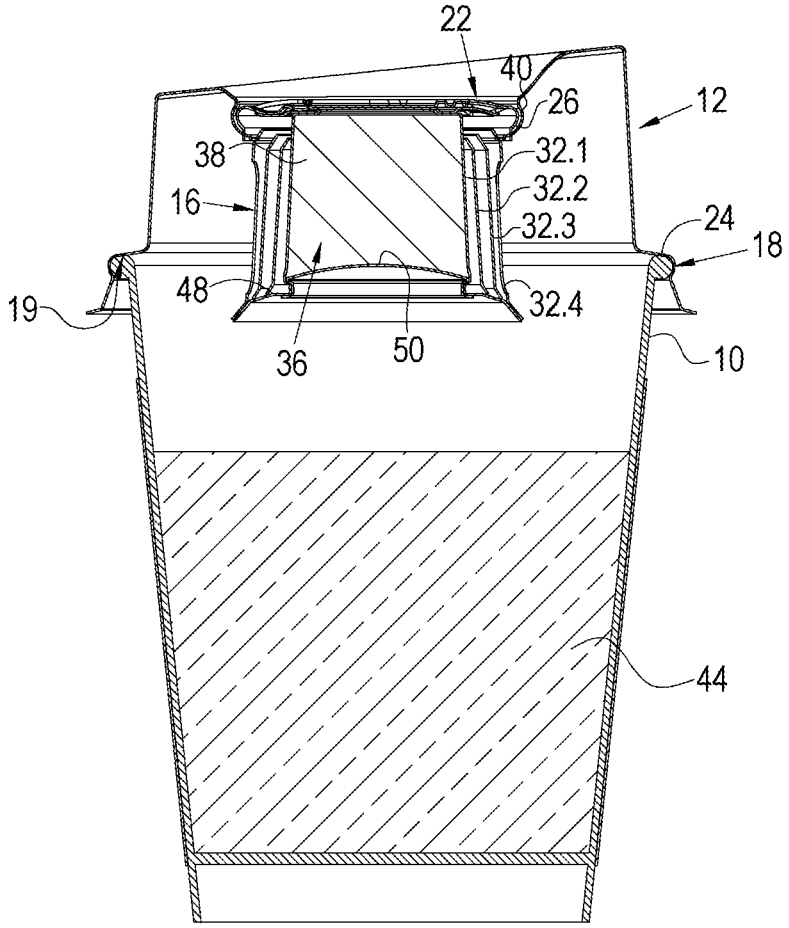
FIG. 4 shows a sectional side view of the drinking cup and lid of FIG. 1, as sectioned along section line IV-IV of FIG. 3.
Figure 5:
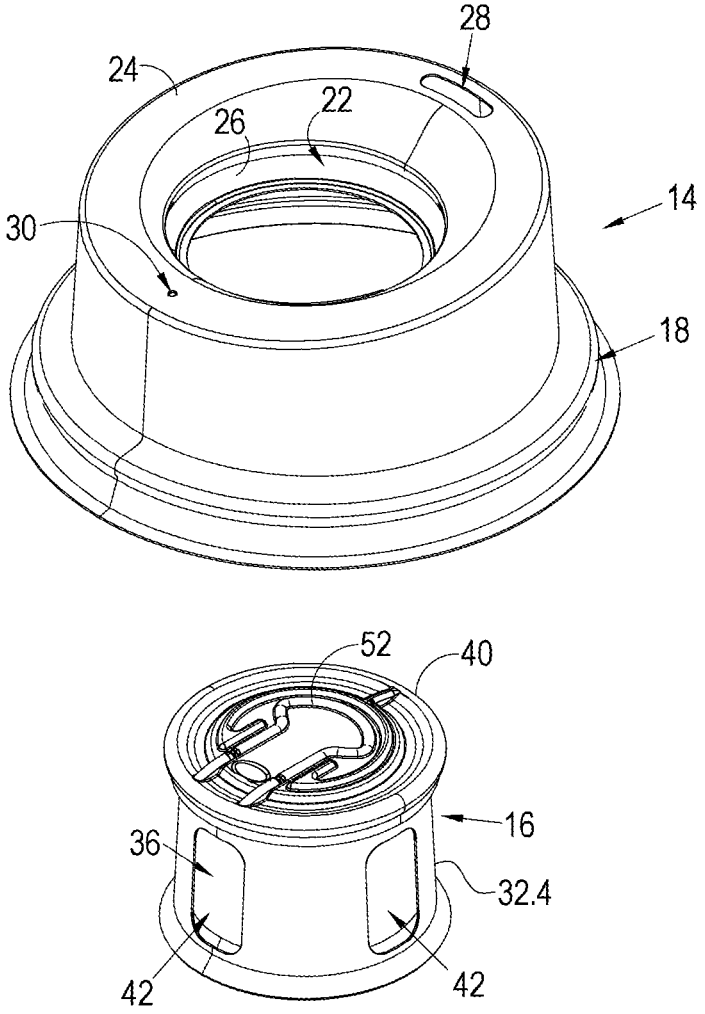
FIG. 5 shows an exploded three-dimensional view of the mixing device of the lid of FIG. 1.
Figure 6:
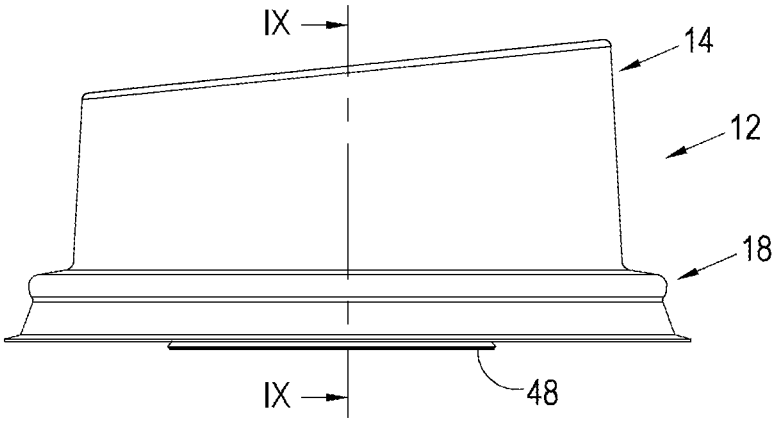
FIG. 6 shows a side view of the lid of FIG. 5.
Figure 7:
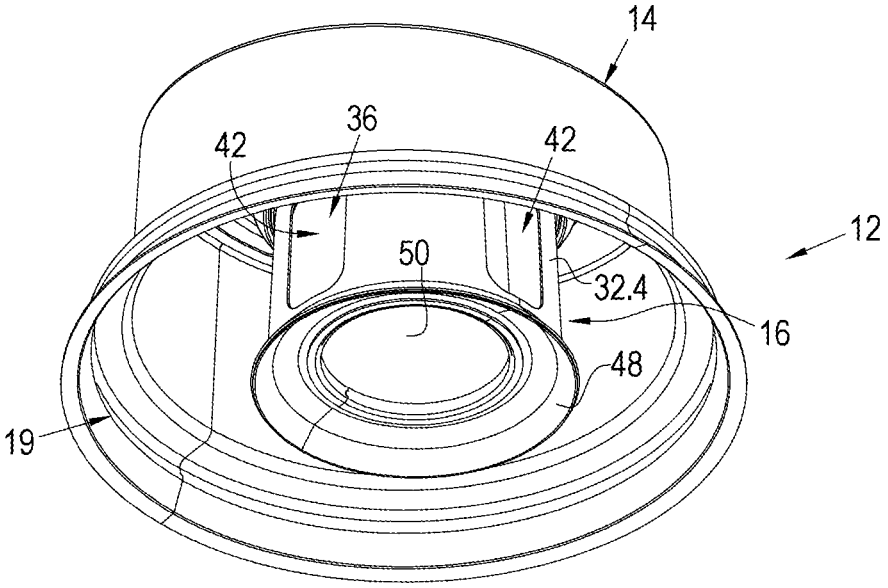
FIG. 7 shows a three-dimensional view of the lid of FIG. 5.
Figure 8:
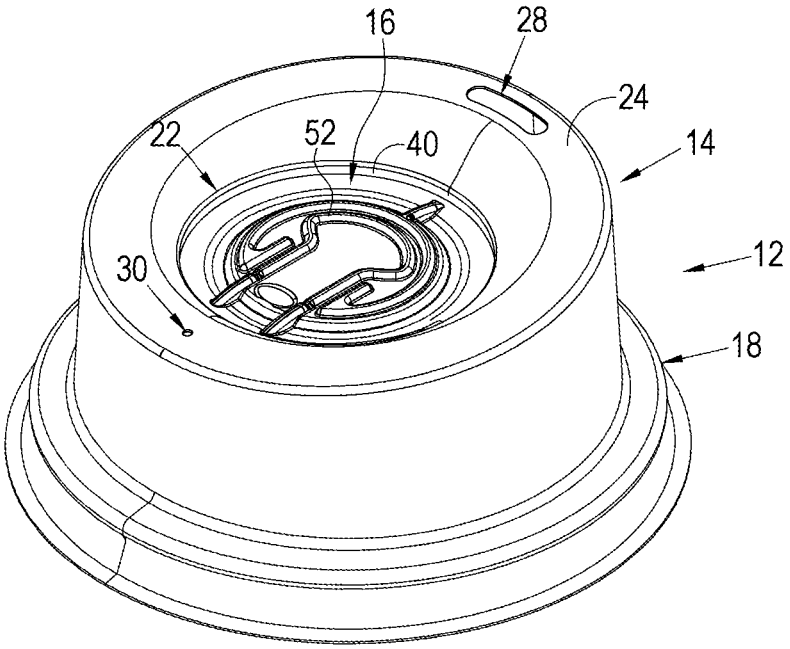
FIG. 8 shows another three-dimensional view of the lid of FIG. 5.
Figure 9:
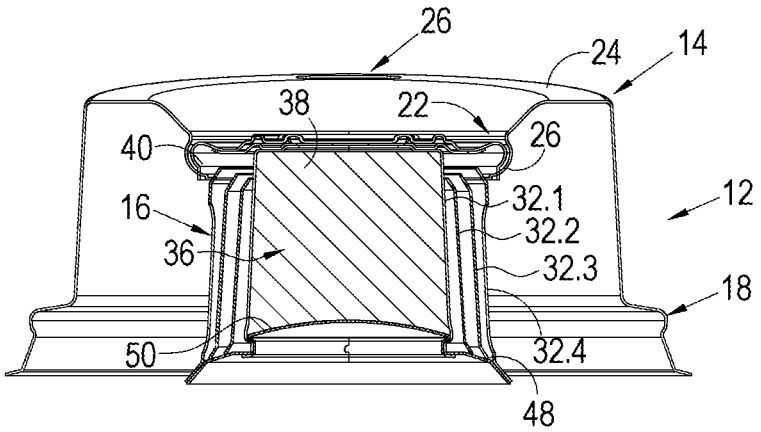
FIG. 9 shows a sectional side view of the lid of FIG. 5, sectioned along section line IX-IX of FIG. 6.

The mixing device 16 includes four tubular mixing elements 32.1, 32.2, 32.3 and 32.4 which are displaceably connected to another. More specifically, the mixing elements are connected to another so as to be telescopically displaceable relative to one another between a retracted condition as shown in FIGS. 4, 7, and 9, and an extended condition wherein the mixing device is raised as shown in FIGS. 10-12 and 17 and wherein the mixing device is lowered as shown in FIGS. 13-16 and 18. The mixing elements have concentric tubular configurations and dimensions wherein, in the retracted condition of the mixing device, the mixing element 32.1 is received within the mixing element 32.2, the mixing element 32.2 is received within the mixing element 32.3 which is in turn is received within the mixing element 32.4.

In the raised and lowered extended conditions of the mixing device, the mixing element 32.1 constitutes the uppermost element, while the mixing element 32.4 constitutes the lowermost element.

The mixing elements 32.1, 32.2, 32.3 and 32.4 include side walls 34.1, 34.2, 34.3 and 34.4, respectively.

The side wall of each of the mixing elements tapers slightly from a lower end thereof towards an upper end thereof.

More specifically, an outer diameter of an upper end region of the side wall 26.3 of the mixing element 32.4 is slightly smaller than an internal diameter of the mounting aperture 20, permitting the mixing device to be telescopically displaced upwardly within the mounting aperture, while an outer diameter of a lower end region of the side wall of the mixing element 32.4 is larger than the internal diameter of the mounting aperture, causing the lower end region of the mixing element 32.4 to engage the inner edge of the mounting aperture 22 preventing further upwards displacement of the mixing element 32.4.

The mixing device 16 includes a condiment holder in the form of a condiment chamber 36 which is defined within the mixing element 32.1, for holding a condiment 38 such as sugar, a sugar substitute, or a sweetener. The condiment may be provided in the form of a disc of compressed material or in granular form. Any reference in this specification to a "condiment" shall be interpreted sufficiently broadly to include a reference to any edible product which may be added to a beverage.

Upper end regions of the side walls 34.2, 34.3, and 34.4 are angled inwardly such that, in the extended condition of the mixing device, the inwardly angled upper end regions deform when they are brought into contact with the adjacent side walls at inner sides thereof as the side walls are telescopically displaced, crashing into the adjacent side walls, thereby gripping the adjacent side walls.

The mixing device includes a cover plate 40 which is connected to the mixing element 32.1. The cover plate forms a liquid tight seal with the abutment formation 26 of the lid cover 14. The cover plate has a larger dimeter than a diameter of the mounting aperture 20 and rests on top of the abutment formation 26 constituting a stop formation preventing the mixing device from passing through the mounting aperture 20 in a downwards direction.

The mixing element 32.4 has a number of circumferentially-spaced slots 42 through which the condiment 38 is discharged into a beverage 44 in the drinking cup 10. The lid 12 is supplied with the mixing device 16 in its inoperative retracted condition as shown in FIG. 4. In the retracted condition, the side wall of the mixing element 32.3 covers the slots 42 in the mixing element 32.4, preventing passage of the condiment therethrough.

The mixing element 32.4 defines an outwardly-projecting circumferential rib formation 46 at an upper end region thereof, which has a larger diameter than a diameter of the mounting aperture 20 thereby preventing the mixing element 32.4 from passing through the mounting aperture 20 when the mixing device is raised within the mounting aperture. As such, the rib formation 46 acts as a stop formation preventing further upwards displacement of the mixing device within the mounting aperture.

The mixing device 16 is displaceably mounted within the mounting aperture 20 of the lid cover 14 so as to permit an up and down bobbing action within a beverage contained within the drinking cup. The cover plate 40 and the rib formation 46 of the mixing element 32.4, thereby capture and permanently retain the mixing device 16 within the mounting aperture 20 of the lid cover 14.

The mixing device 16 includes a base plate 48 which is permanently connected to a lower end of the mixing element 32.4 and which closes off a lower end of the condiment chamber 36. The base plate has a central raised dome-shaped boss 50. The dome shape of the boss promotes a flow of condiment, particularly a condiment provided in granular form, to flow towards the slots 42 and into a beverage in the drinking cup.

Figure 10:
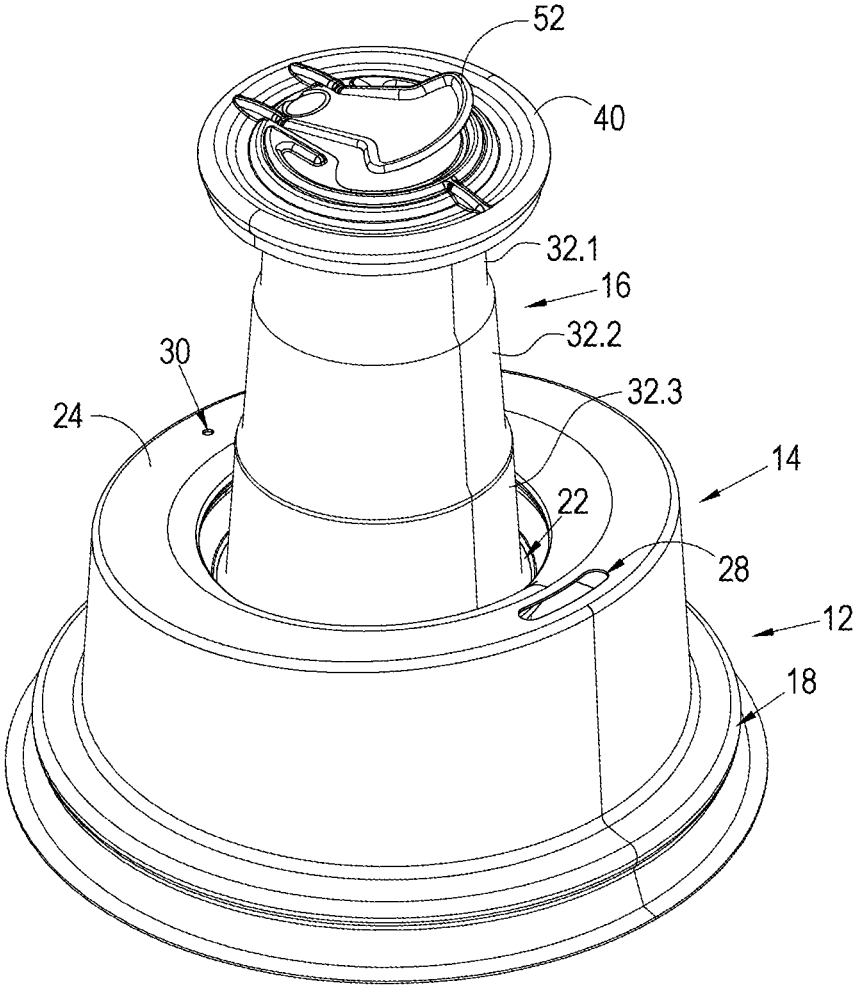
FIG. 10 shows a three-dimensional view of the lid of FIG. 1, with the mixing device in an extended, raised position.
Figure 11:
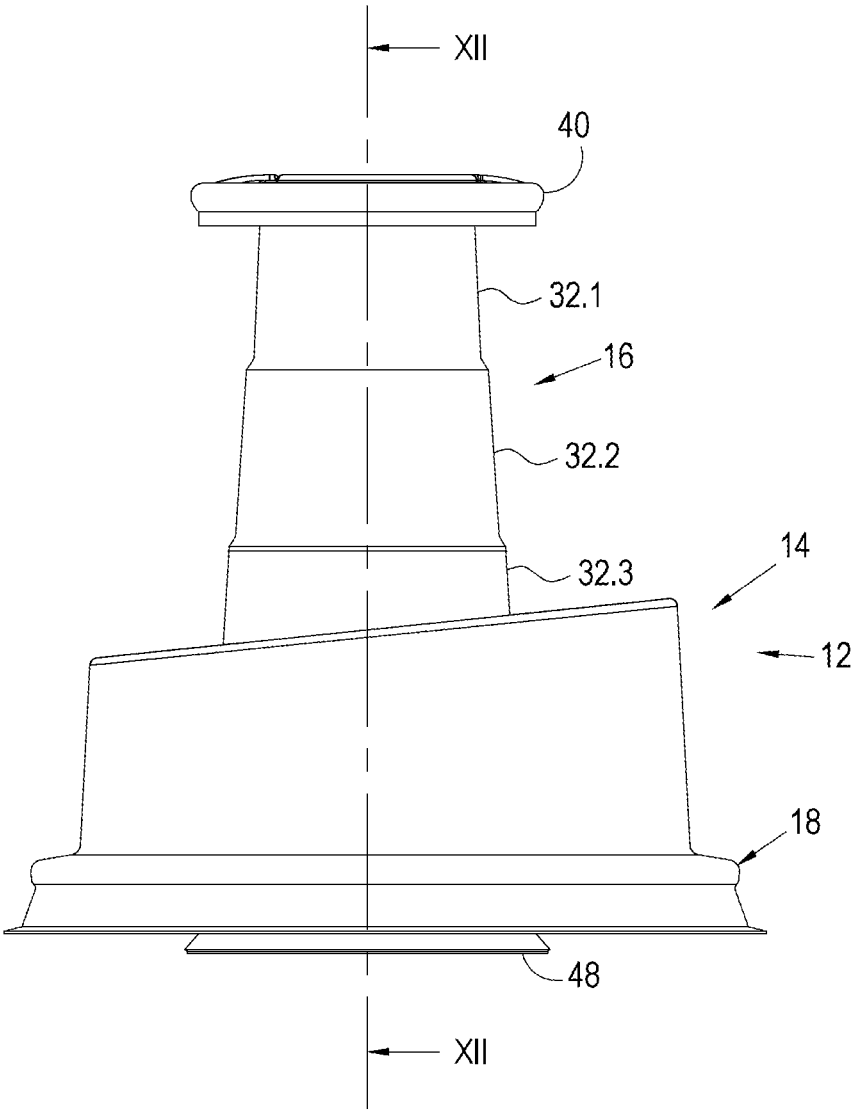
FIG. 11 shows a side view of the lid of FIG. 10.
Figure 12:
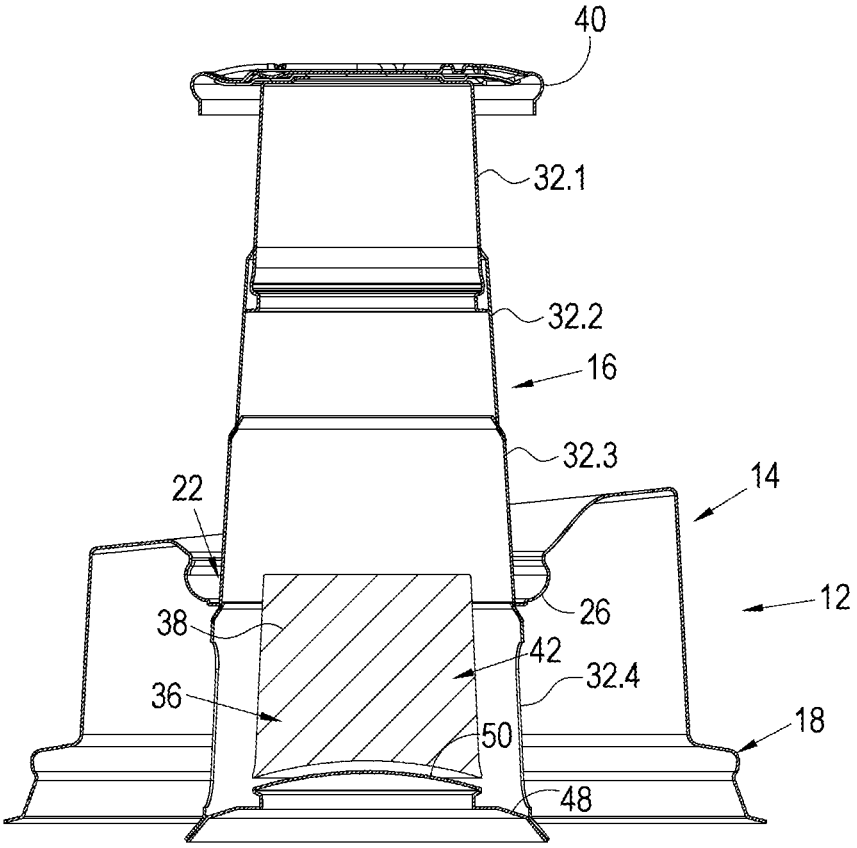
FIG. 12 shows a sectional side view of the lid of FIG. 10, sectioned along section line XII-XII of FIG. 11.
Figure 13:
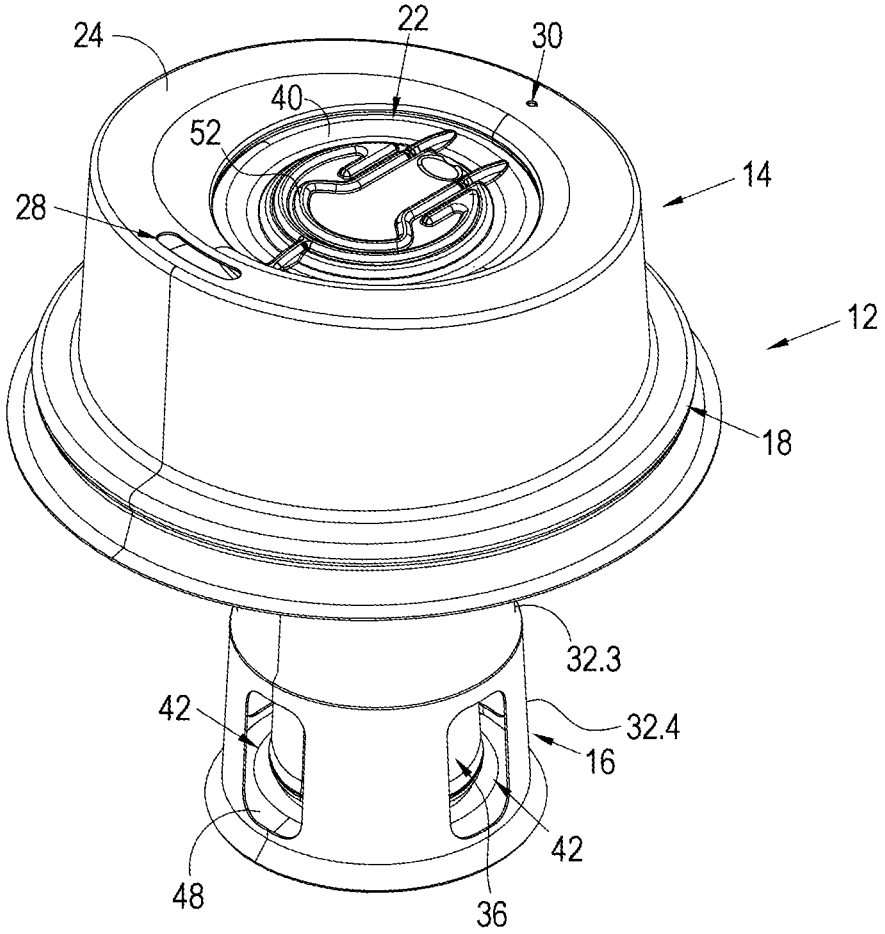
FIG. 13 shows a three-dimensional view of the lid of FIG. 1, with the mixing device in an extended, lowered position.
Figure 14:
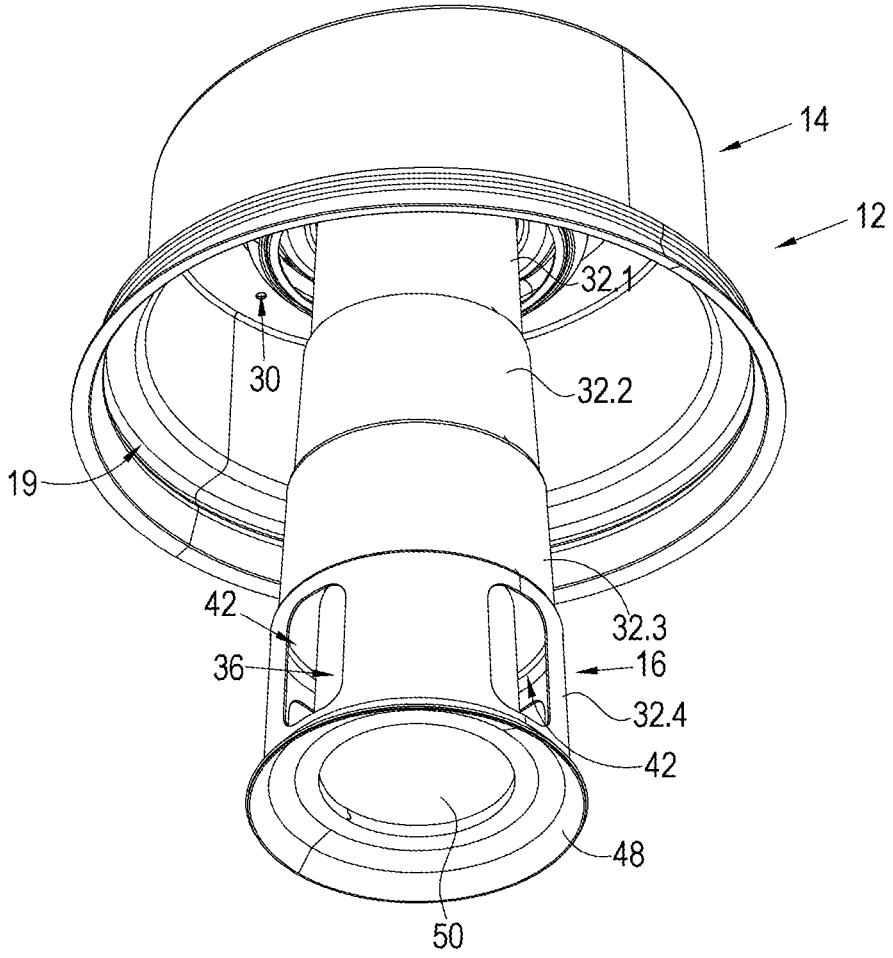
FIG. 14 shows another three-dimensional view of the lid of FIG. 12.
Figure 15:
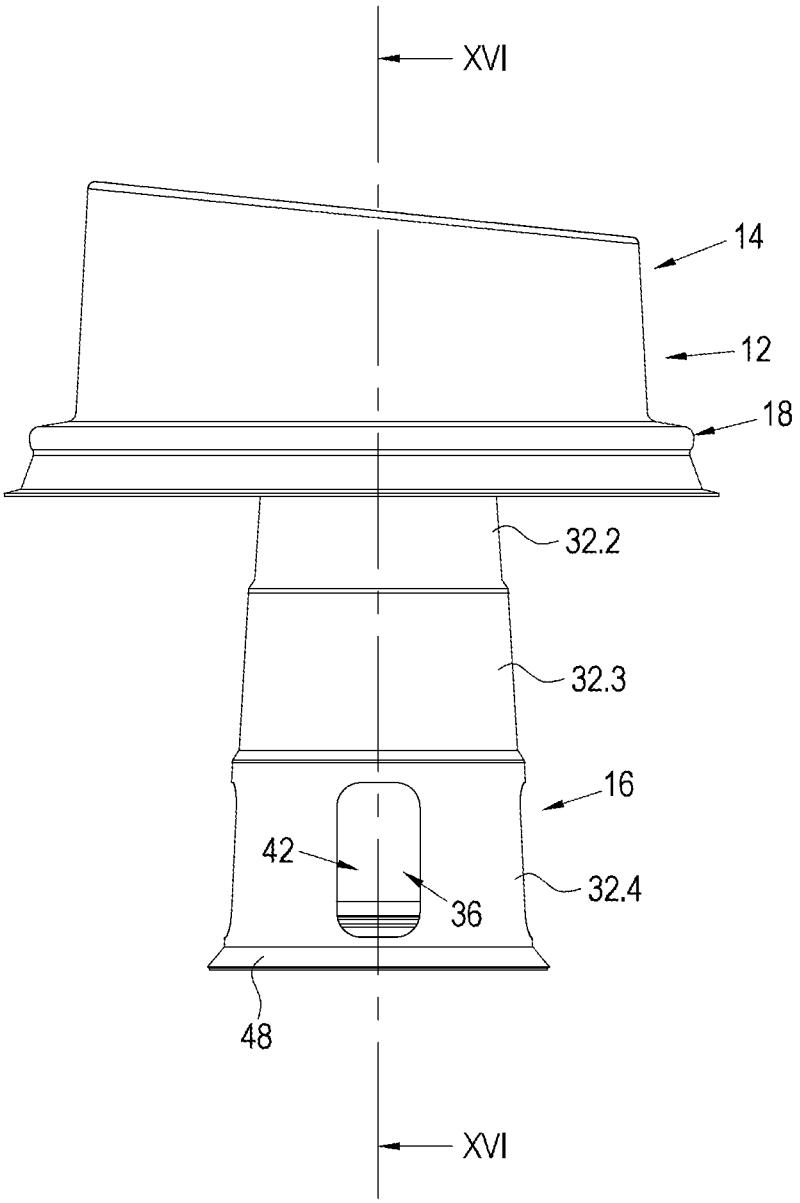
FIG. 15 shows a side view of the lid of FIG. 8.
Figure 16:
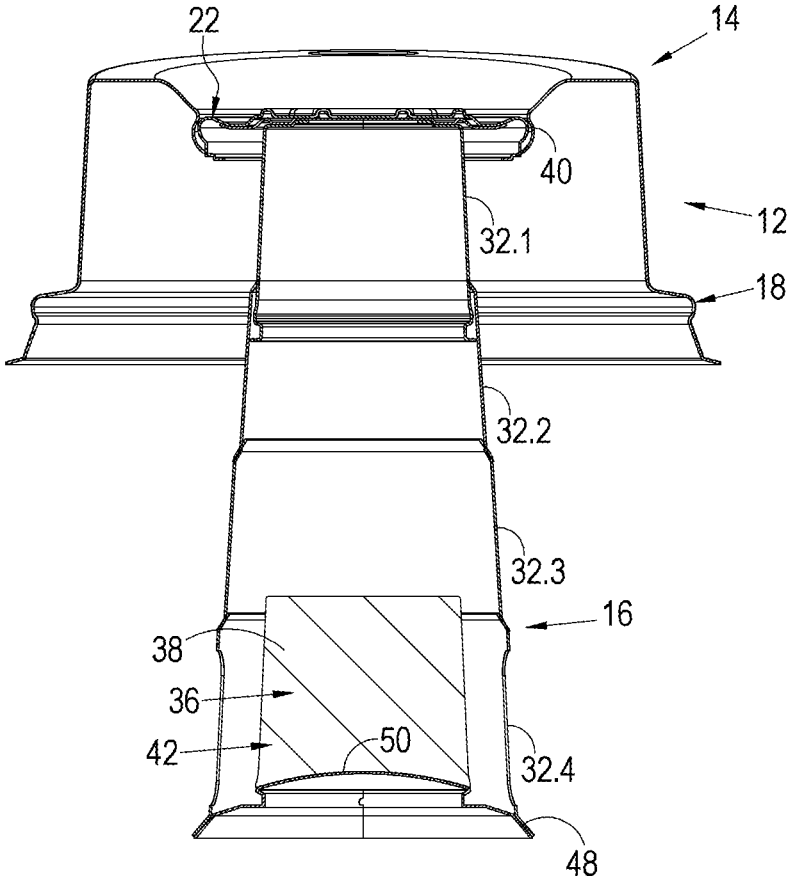
FIG. 16 shows a sectional side view of the lid of FIG. 13, sectioned along section line XVI-XVI of FIG. 13.
Figure 17:
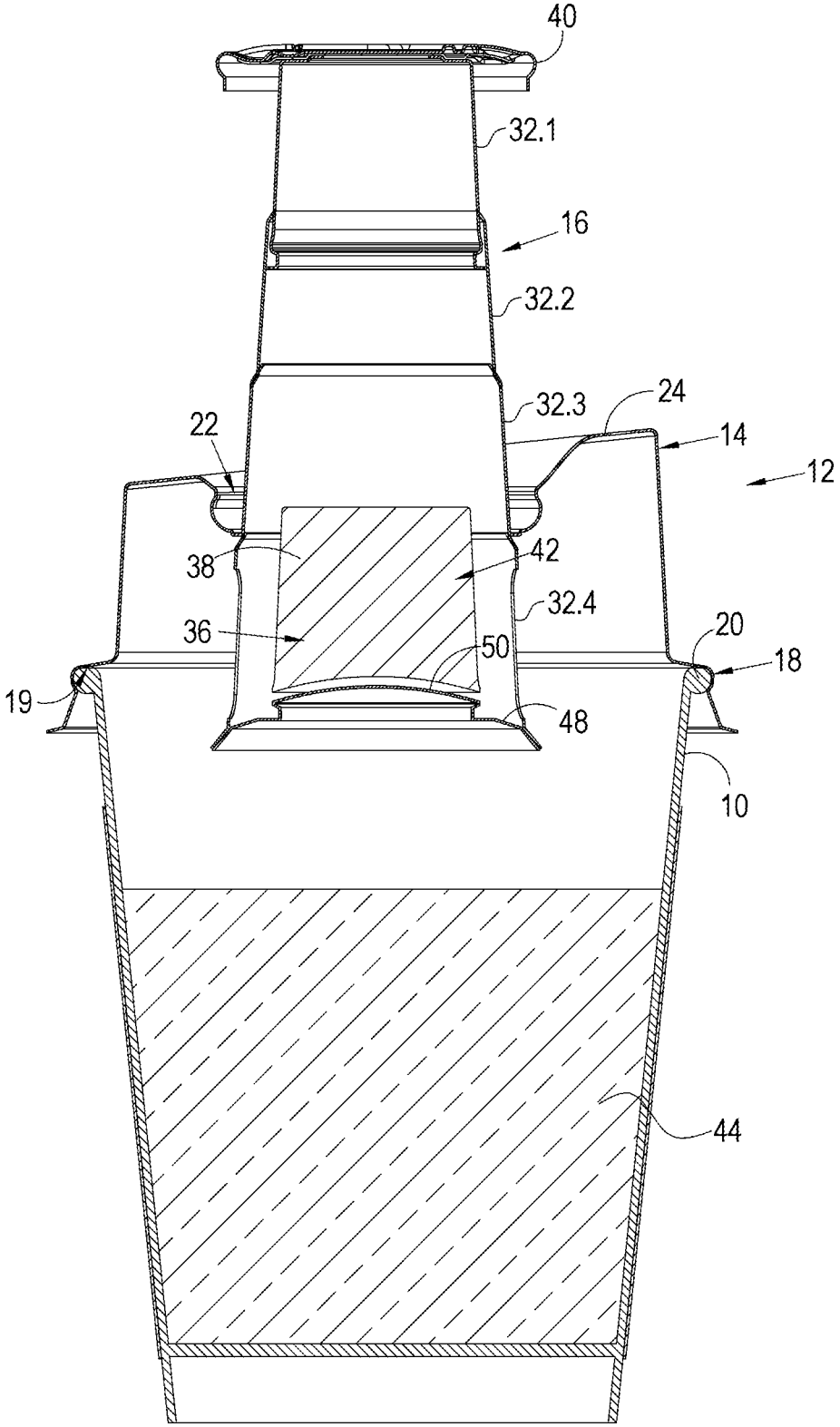
FIG. 17 shows a sectional side view of the drinking cup and lid of FIG. 1, with the mixing device in the extended raised position.
Figure 18:
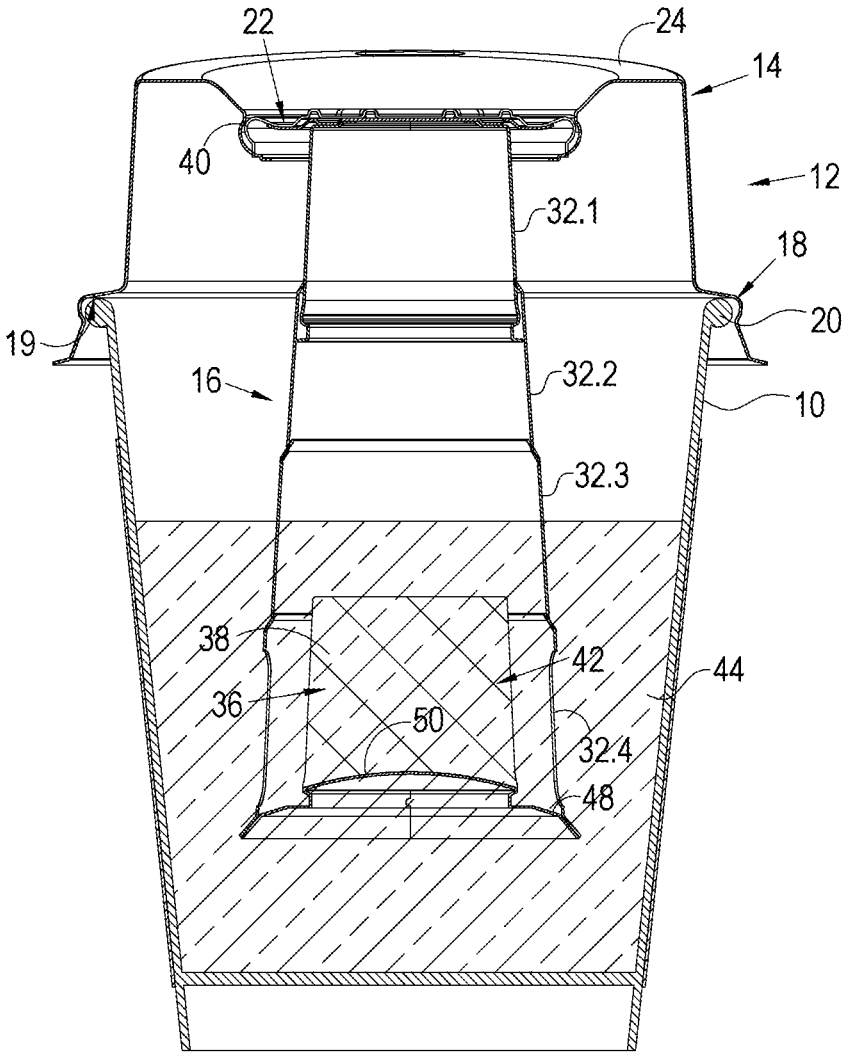
FIG. 18 shows a sectional side view of the drinking cup and lid of FIG. 1, with the mixing device in the extended lowered position.

A handle formation 52 is provided on the cover plate, which can be held and manipulated for exerting a pulling force on the mixing element 32.1 in order to telescopically displace the mixing elements upwards and the mixing device into its raised extended condition as shown in FIGS. 10, 11, 12, and 17. The handle 52 is hingedly attached to the cover plate 40 so as to be displaceable between a raised position (as shown in FIG. 10) in which the handle can be gripped for manipulating the cover plate and a lowered position wherein the handle is located flush against the cover plate so as to provide the lid with a compact space-saving profile for packaging and storage purposes. In order for the mixing device 16 to be used for mixing the condiment 38 into a beverage 11 in the drinking cup 10, the mixing device is then lowered through the mounting aperture 20 until a lower end region of the mixing device, including the condiment holder, is submerged in the beverage. The mixing device can then be manipulated by holding the handle 36 by imparting an up and down bobbing mixing action to the mixing device or by stirring the mixing device in order to release the condiment into the beverage and agitate the beverage in the drinking cup in order to promote mixing and dissolving of the condiment in the beverage.

The disclosure extends to the dinking cup 10 having the lid 12 fitted thereto.

The Applicant envisages that the lid 12 will be manufactured of a recyclable plastics material in a hygienic automated manufacturing process without the need for handling of components by humans during the manufacturing process. After assembly of the mixing device to the lid cover, the lid is hermetically vacuum sealed in a film wrapper wherein the wrapper hugs the contours of the lid so as to retain the shape of the lid for stacking purposes and prevent human contact with the lid until it is unwrapped for use by an end user. In this manner, the handling of separate lids and individually packaged condiments at manufacture and along the supply chain to the coffee vendor and by baristas when preparing a coffee for a customer is avoided, thereby mitigating the risk of transmission of communicable diseases such as the highly contagious Covid-19 virus. The Applicant envisages that drinking cups will be similarly hermetically wrapped in order to provide a drinking cup and lid that poses minimal health risks to end users.

In addition, the Applicant believes that the provision of a lid wherein the lid cover and mixing device are permanently attached to one another and therefore constitute a single unit, will allow for disposal of the components of the lid as a single unit for recycling, thereby avoiding the disposal of the lid cover and mixing device separately. The provision of the lid as a single packaged unit with the condiment already included will reduce the risk of theft, shrinkage, wastage and mess as all of the components required in order to add a condiment, mix it into a beverage and cover the drinking cup containing the beverage are provided in a single unit wherein the condiment is incorporated in the lid. The Applicant believes that this will also reduce the time required in order to prepare a beverage which is of particular importance in the preparation of take-away coffee beverages.

The disclosure provides a convenient and easy-to-use lid for a drinking cup, which obviates the need for a user to follow the steps typically followed when adding a condiment to a take away beverage, namely, using both hands to open a condiment package as is the case with conventional packages containing condiments, pouring the condiment into a drinking cup, locating a spoon or other stirring device, using it to mix the condiment into the beverage and thereafter disposing of the packaging and the stirrer.

The provision of a lid incorporating a mixing device and a condiment in a single unit will greatly simplify the maintenance of stock levels by vendors.

For the reasons set out above, the Applicant believes that the disclosure addresses the problems encountered with the provision of beverages in drinking cups to consumers listed under the Background in this specification. The Applicant further believes that the disclosure promotes a shared value model wherein the four major shareholders, namely, the manufacturer, the retailer, the consumer and society at large will benefit from the disclosure.

The various embodiments described above can be combined to provide yet further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A lid for an open-topped drinking cup comprising:

a lid cover which is attachable to the drinking cup at an upper end thereof, the lid cover defining a drinking hole through which a beverage held in the drinking cup can be consumed and a separate breather hole allowing for ingress of air as the beverage is consumed, the lid cover including a lip portion defining an annular groove which snap fits onto a complementary annular tongue of a rim of the drinking cup; and a mixing device for agitating the beverage in the drinking cup, wherein the lid cover defines a mounting aperture within which the mixing device is located in an arrangement permitting displacement of the mixing device within the mounting aperture, the mixing device including:

at least two mixing elements which are telescopically displaceable relative to one another between a retracted condition and an extended condition, one of the mixing elements being an operative upper mixing element and another one of the mixing elements being an operative lower mixing element;

the lower mixing element defining a condiment chamber within which a condiment is held and having at least one discharge opening through which the condiment is discharged from the condiment chamber when the mixing elements are in the extended condition, the lower mixing element having a base plate which closes off a lower end of the condiment chamber, and a side wall of another one of the mixing elements overlapping and thereby closing off the discharge opening of the lower mixing element in the retracted condition of the mixing elements; and a cover plate connected to the upper mixing element, the cover plate forming a liquid tight seal with the lid cover when the mixing elements are in the retracted condition thereby closing off an upper end of the condiment chamber in the retracted condition of the mixing elements, the mixing device being displaceable within the mounting aperture when the mixing elements are in the extended condition, so as to promote a release of the condiment from the condiment chamber into the beverage and to agitate the beverage promoting mixing of the condiment into the beverage.

2. The lid as claimed in claim 1, wherein the mixing device is configured so as to be permanently retained within the mounting aperture of the lid cover of the drinking cup.

3. The lid as claimed in claim 1, wherein the mixing device includes an upper stop formation near an operative upper end of the mixing device and a lower stop formation near an operative lower end of the mixing device, the upper and lower stop formations being operable to abut an abutment formation of the lid cover when the mixing device is lowered and raised, respectively, within the mounting aperture, thereby capturing and permanently retaining the mixing device within the mounting aperture.

4. The lid as claimed in claim 3, wherein the upper mixing element includes the upper stop formation and the lower mixing element includes the lower stop formation.

5. The lid as claimed in claim 1, wherein the mixing elements have concentric tubular configurations wherein one of the mixing elements is seated within another mixing element in the retracted condition of the mixing device.

6. The lid as claimed in claim 1, wherein the mixing device is displaceably mounted within the mounting aperture of the lid cover so as to permit an up and down bobbing action of the mixing device when the mixing elements are in the extended condition, within the beverage contained within the drinking cup.

7. The lid as claimed in claim 1, wherein the mixing device includes a handle formation which is connected to the upper mixing element and which can be held and manipulated for exerting pulling and pushing forces on the upper mixing element for alternately raising and lowering the mixing device, respectively, within the mounting aperture for imparting an up and down bobbing action to the beverage in order to release the condiment into the beverage and promote mixing of the condiment in the beverage.

8. The lid as claimed in claim 1, wherein the mixing device includes one or more intermediate mixing elements telescopically interconnected between the upper and lower mixing elements.

9. A combination drinking cup and lid wherein the drinking cup is the drinking cup as recited in claim 1 and the lid is the lid as claimed in claim 1, wherein the lid is fitted to the upper end of the drinking cup.

* * * * *